US005220391A

United States Patent [19]

Tange

[11] Patent Number: 5,220,391

[45] Date of Patent: Jun. 15, 1993

[54] IMAGE FORMING APPORATING HAVING CLEANING ROLLER ROTATABLE AT DIFFERENT SPEEDS DURING PERIODS OF IMAGE FORMATION AND NON-IMAGE FORMATION

[75] Inventor: Keigo Tange, Okazaki, Japan

[73] Assignee: Minolta Camera Kabushiki Kaisha, Osaka, Japan

[21] Appl. No.: 950,724

[22] Filed: Sep. 24, 1992

Related U.S. Application Data

[63] Continuation of Ser. No. 731,139, Jul. 15, 1991, abandoned.

[30] Foreign Application Priority Data

Jul. 16, 1990 [JP] Japan ..... 2-188719

[51] Int. Cl.[5] ..... G03G 21/00

[52] U.S. Cl. ..... 355/297; 355/299

[58] Field of Search ..... 355/296, 297, 299, 301

[56] References Cited

U.S. PATENT DOCUMENTS

| | | | |
|---|---|---|---|
| 3,438,706 | 4/1969 | Tanaka et al. | 355/210 |
| 3,927,937 | 12/1975 | de Keyzer | 355/298 |
| 3,950,092 | 4/1976 | Zoltner | 355/298 |
| 4,131,359 | 12/1978 | Honda | 355/299 X |
| 4,449,241 | 5/1984 | Nakayama | 355/299 X |
| 4,613,229 | 9/1986 | Miyake et al. | 355/296 |
| 4,972,233 | 11/1990 | Yamazaki et al. | 355/297 X |
| 4,975,748 | 12/1990 | Koinuma et al. | 355/296 X |

FOREIGN PATENT DOCUMENTS

| | | |
|---|---|---|
| 60-33582 | 2/1985 | Japan . |
| 61-34579 | 2/1986 | Japan . |

*Primary Examiner*—Fred L. Braun

*Attorney, Agent, or Firm*—Willian Brinks Olds Hofer Gilson & Lione

[57] ABSTRACT

A cleaning device for removing substances remaining on a rotatable image holding member in an image forming apparatus, which includes:

a cleaning roller rotatably supported in a state contacting the image holding member so as to remove the substances remaining on a surface of the image holding member, and a drive change-over device arranged to change-over driving so as to rotate the cleaning roller following rotation of the image holding member during a period in which image formation is effected by the image holding member, and to impart a speed difference to the cleaning roller with respect to the image holding member during other periods in which the image formation is not effected.

7 Claims, 6 Drawing Sheets warm-up completion signal
prelim. rotation
copy signal
Image form. Fwd. rotation
Image form. Bwd. rotation
copy signal
Image form. Fwd. rotation
Between images
Image form. Bwd. rotation
Photoreceptor
Erase
Charge
Exposure
Developing
Transfer
Clutch
Main motor M1
Cleaner motor M2
ON
OFF

IMAGE FORMING APPORATING HAVING CLEANING ROLLER ROTATABLE AT DIFFERENT SPEEDS DURING PERIODS OF IMAGE FORMATION AND NON-IMAGE FORMATION

This application is a continuation of application Ser. No. 07/731,139, filed Jul. 15, 1991, now abandoned.

BACKGROUND OF THE INVENTION

The present invention generally relates to a cleaning arrangement for use in an image forming apparatus, and more particularly, to an improvement of a cleaning device provided with a cleaning roller.

Conventionally, as a cleaning device provided with a rotatable cleaning roller pressed against the surface of an image holding member for removal of toner remaining on said image holding member after transfer, there have been known two types of cleaning devices as referred to below.

(1) A cleaning device of a type arranged to cause the cleaning roller to rotate following rotation of the image holding member (disclosed, for example, in Japanese Patent Laid-Open Publication Tokkaisho No. 60-33582).

(2) Another type of a cleaning device adapted to forcibly drive the cleaning roller for rotation at a speed different from a moving speed of the surface of the image holding member (disclosed, for example, in Japanese Patent Laid-Open Publication Tokkaisho No. 61-34579).

In the known cleaning device of the above item (1), however, since friction force between the image holding member and the cleaning roller is small, residual toner fused and solidified, paper powder and loading material in the paper powder (talc, kaolin or the like), or products of corona discharge by a corona charger and transfer charger to be produced on the image holding member, etc. undesirably remain on the surface of said image holding member without being removed (Such remaining substances are generally referred to as residual toner, etc. hereinafter). Thus, as a series of image forming functions is repeatedly effected, residual toner, etc. remaining without being removed is accumulated on the surface of the image holding member, thus resulting in such a defect as soiling of images by the residual toner, etc.

On the other hand, in the conventional cleaning device of the above item (2), since the speed difference is imparted to the cleaning roller with respect to the image holding member which is being driven, the friction force between the image holding member and the cleaning roller may be increased, and therefore, the residual toner, etc. on the image holding member can be removed. However, due to the fact that the friction force also acts as resistance against rotation of the image holding member, irregular rotation of said image holding member tends to take place, thus adversely affecting the quality of images in some cases. More specifically, the resultant image is disturbed by slippage taking place in the exposure position or transfer position, or irregularity may take place in the density of the image to be formed through variation of time in which a developing device contributes to developing in a developing region.

In order to overcome the disadvantages as described above, there may be considered to form the surface of the cleaning roller by a material having a small friction coefficient so as to prevent the friction force between the image holding member and the cleaning roller from increasing. However, in this case, it is difficult to select a material which is capable of achieving a sufficient cleaning characteristic, and can simultaneously provide a friction force which will not give resistance to rotation of the image holding member.

SUMMARY OF THE INVENTION

Accordingly, an essential object of the present invention is to provide a cleaning device which will not disturb resultant images due to irregular rotation of an image holding member even when a cleaning roller is employed for sufficient cleaning of the image holding member in an efficient manner.

Another object of the present invention is to provide a cleaning device of the above described type which is simple in construction and stable in functioning at high reliability, and can be readily incorporated into various image forming apparatuses at low cost.

In accomplishing these and other objects, according to one preferred embodiment of the present invention, there is provided a cleaning device for use in an image forming apparatus arranged to form an electrostatic latent image through exposure of an image onto an image holding member driven for rotation so as to effect transfer by developing the electrostatic latent image into a toner image.

The cleaning device includes a cleaning roller pressed against the surface of said image holding member and rotatably supported, and a drive change-over means arranged to cause the cleaning roller to follow rotation of the image holding member at least during one period from starting of image exposure with respect to the image holding member, to completion of transfer of the developed toner image and to impart a speed difference to said cleaning roller with respect to the image holding member during periods other than said one period.

It is to be noted here that said speed difference includes the stopping, at either one side, rotation in the opposite direction, and slippage in the same direction, etc.

In the arrangement according to the present invention as described above, since the cleaning roller is only rotated following the rotation of the image holding member during the period from the starting of the image exposure with respect to the image holding member up to completion of the image transfer with respect to the transfer material, no irregular rotation takes place on the image holding member. On the other hand, in the periods excluding the above period, the cleaning roller is provided with the speed difference with respect to the image holding member, and therefore, the surface of the image holding member corresponding to said period is forcibly rubbed by the cleaning roller for sufficient cleaning. In the above case, even if irregular rotation takes place on the image holding member, it occurs only after transfer, and thus, there is no adverse effect to the image to be formed on the transfer material.

BRIEF DESCRIPTION OF THE DRAWINGS

These and other objects and features of the present invention will become apparent from the following description taken in conjunction with the preferred embodiment thereof with reference to the accompanying drawings, in which.

DETAILED DESCRIPTION OF THE INVENTION

Figure 1:
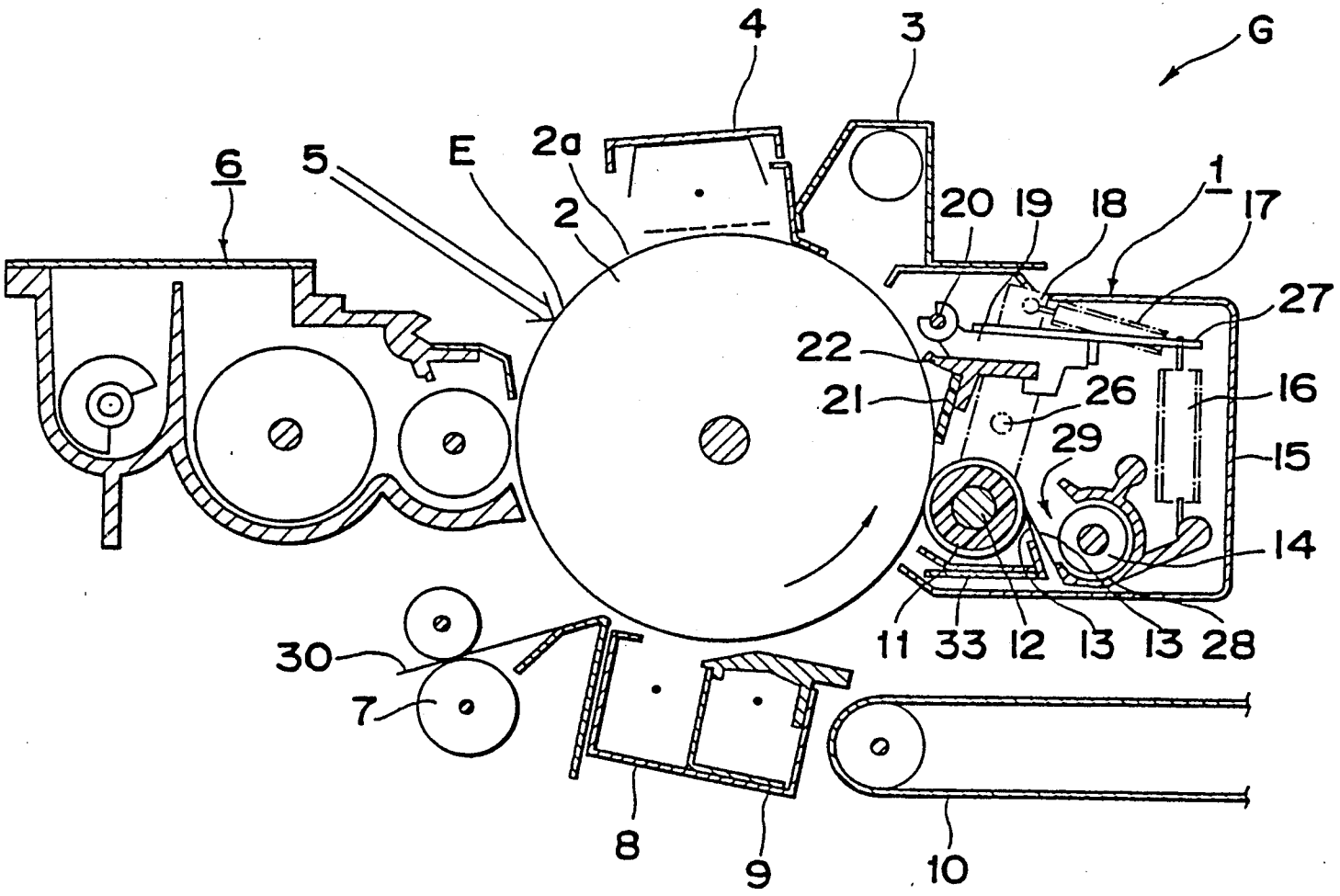
FIG. 1 is a schematic side sectional view of an image forming apparatus to which a cleaning device according to one preferred embodiment of the present invention may be applied.

Before the description of the present invention proceeds, it is to be noted that like parts are designated by like reference numerals throughout the accompanying drawings.

Referring now to the drawings, there is shown in FIG. 1, an image forming apparatus G in which a cleaning device 1 according to one preferred embodiment of the present invention is employed.

Before describing constructions of the cleaning device 1 of the present invention, general functioning of the image forming apparatus G of FIG. 1 will be briefly explained hereinbelow.

The image forming apparatus G generally includes a photosensitive or photoreceptor 2 in the form of a drum rotatably provided at approximately a central portion of the apparatus G and having a photosensitive surface 2*a* provided on the outer periphery thereof, and various processing stations such as an eraser lamp 3, a corona charger 4, an exposure station E, a developing device 6, a transfer charger 8, a transfer material separating charger 9, a transport belt 10, and the cleaning device 1 directly related to the present invention, all of which are sequentially disposed around said photoreceptor drum 2 for performing the image forming process as intended.

In FIG. 1, the photosensitive surface 2*a* of the photoreceptor drum 2 from which residual charge has been removed by the eraser lamp 3 is uniformly charged by the corona charger 4, and thereafter, subjected to projection of a light image 5 corresponding to the image information at the exposure station E so as to be formed with an electrostatic latent image of the light image 5 thereon. This electrostatic latent image is developed into a visible toner image by toner supplied from the developing device 6. The toner image thus developed is transferred by the transfer charger 8, onto a transfer material 30, e.g. a copy paper sheet or the like transported through synchronization by a timing roller 7. Thereafter, the transfer material 30 is separated from the photosensitive surface 2*a* of the photoreceptor drum 2 by the separating charger 9 so as to be fed to a subsequent process by the transport belt 10.

Meanwhile, the toner remaining on the photosensitive surface 2*a* of the photoreceptor drum 2 without being transferred at the transfer process is removed by the cleaning device 1 directly related to the present invention together with foreign matters such as paper powder, etc., and thus, the photoreceptor 2 is ready for the next copying process.

1st Embodiment

Subsequently, referring particularly to FIGS. 1 to 3, constructions of the cleaning device 1 according to one preferred embodiment of the present invention will be described in detail hereinafter.

Figure 2:
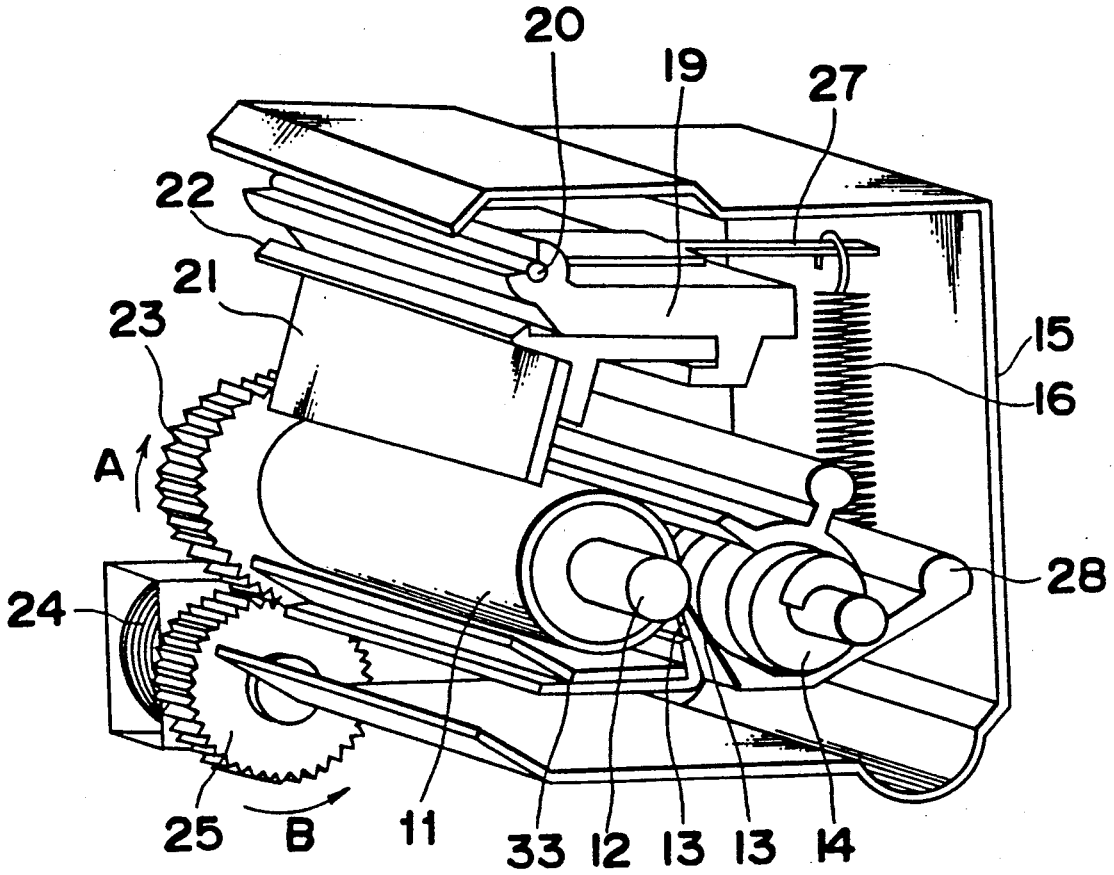
FIG. 2 is a perspective view showing on an enlarged scale, the cleaning device of the present invention as employed in the apparatus of FIG. 1.
Figure 3:
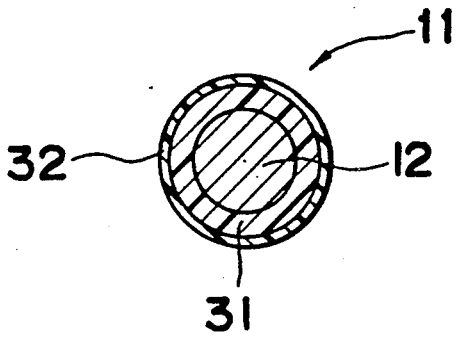
FIG. 3 is a cross section of a cleaning roller employed in the cleaning device of FIG. 2.

As shown in FIGS. 1 and 2, the cleaning device 1 mainly includes a cleaning blade 21, a cleaning roller 11 and a toner collecting portion 28. The cleaning blade 21 is held by a blade holder 22 at its edge opposite to that contacting the surface 2*a* of the photoreceptor drum 2, and said blade holder 22 is further supported by a holder support 19 pivotally mounted about a shaft 20 provided on a frame 15 of the cleaning device 1. At a central portion in a longitudinal direction on the upper surface of the holder support 19, there is provided a lever 27, to which one end of a tension spring 16 fixed at its other end to a toner collecting portion 28 to be described later, is connected, and by the action of this tension spring 16, the lever 27 is normally urged downwardly. By the arrangement as described above, the cleaning blade 21 is held in pressure contact with the photosensitive surface 2*a* of the photoreceptor drum 2.

On the other hand, the cleaning roller 11 has its rotary shaft 12 rotatably supported at end portions of a pair of roller pressing members 18 pivotally supported about pins 26. As is most clearly seen in FIG. 3, the cleaning roller 11 includes an expanded polyurethane layer 31 provided around the rotary shaft 12, and a polyurethane rubber layer 32 of 0.8 mm thick further provided over said expanded polyurethane layer 31. At an upper end (FIG. 1) of each of the roller pressing members 18, one end of a coil spring 17 fixed, at its other end, to the frame 15 of the cleaning device is connected, and by these coil springs 17, the roller pressing members 18 are normally urged in a clockwise direction in FIG. 1. By the arrangement as described above, the cleaning roller 11 is pressed against the surface 2*a* of the photoreceptor drum 2.

At one end of the rotary shaft 12 of the cleaning roller 11, there is fixedly mounted a gear 23, which is in mesh with another gear 25 secured to an output shaft of a clutch 24 provided as a drive change-over means.

With the surface of the cleaning roller 11 opposite to that contacting the surface 2*a* of the photoreceptor 2, a set of scrapers 13 are held in contact for scraping off toner adhering to the cleaning roller 11, with base edges of said scrapers 13 being respectively fixed to corresponding edges of the tone collecting portion 28 and a toner receptacle 33 disposed under the roller 11. The toner scraped off by the scrapers 13 from the cleaning roller 11 is collected into said toner collecting portion 28 provided at the side remote from the cleaning roller 11, with the scrapers 13 provided therebetween. The toner collecting portion 28 is formed to be hollow inside, and an opening 29 is provided at its side confronting the scrapers 13. Moreover, in the hollow interior of the toner collecting portion 28, there is disposed a collecting spiral member 14 rotatably supported by the frame 15 for being driven for rotation.

Figure 4:
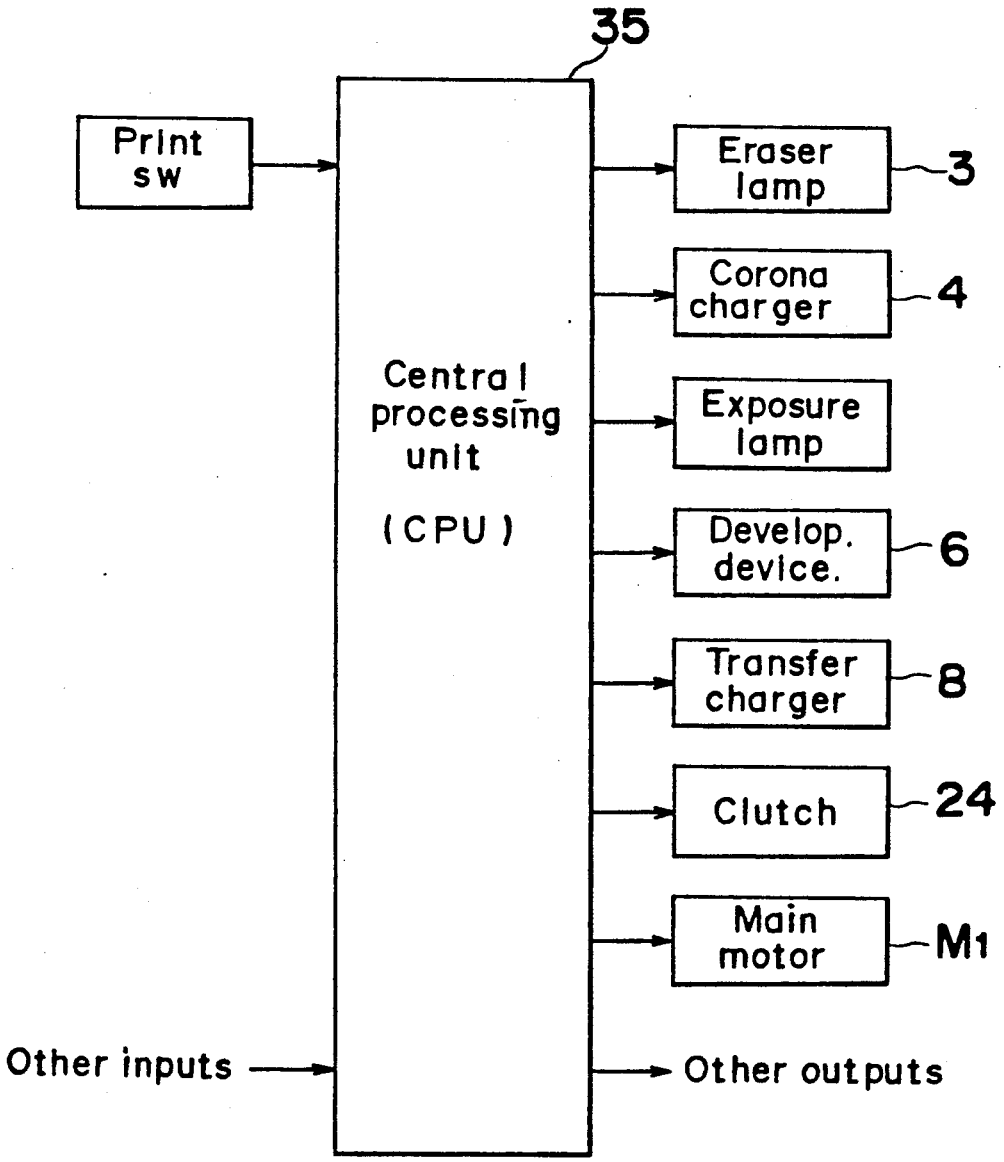
FIG. 4 is a block diagram of a control circuit for controlling the image forming apparatus provided with the cleaning device of the present invention.

Referring further to FIG. 4, there is shown a block diagram for a control circuit for controlling the image forming apparatus G to which the cleaning device 1 of the present invention may be applied.

In FIG. 4, various inputs such as signals from a print switch, and other inputs, etc. are applied to an input side of a CPU (central processing unit) 35, in which a timer means to be started by a signal input from the print switch is set (not particularly shown). According to values of said timer means, the CPU 35 outputs signals for driving the eraser lamp 3, the corona charger 4, an exposure lamp, the developing device 6, the transfer charger 8, the clutch means 24, and a main motor M1 for driving the photoreceptor drum 2, etc. referred to earlier.

Figure 5:
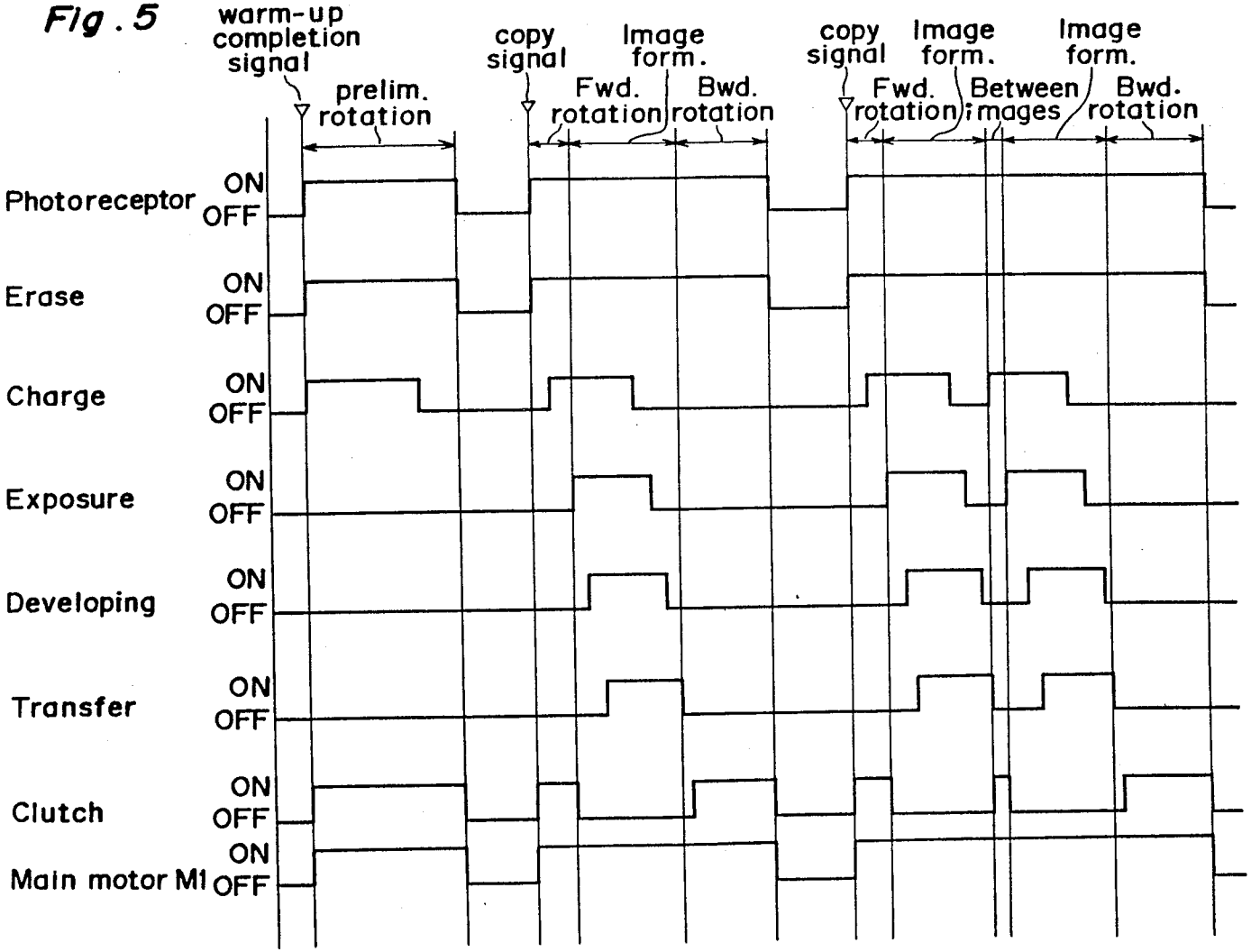
FIG. 5 is a time-chart for explaining functions of the cleaning device according to the present invention.

Subsequently, functioning of the cleaning device 1 will be described by referring to a time-chart of FIG. 5. It is to be noted here that in FIG. 5, "clutch ON" represents the connected or engaged state of the clutch 24, while "clutch OFF" denotes the disconnected or disengaged state thereof.

In the first place, timing for connection and disconnection of the clutch 24 will be explained according to flow of time in FIG. 5.

(i) When the power supply for the image forming apparatus G is turned ON, and upon completion of warming-up of a fixing device (not shown), the clutch 24 is connected at the timing in which a warming-up completion signal is outputted from the CPU 35, and simultaneously, the main motor M1 is driven to rotate the photoreceptor drum 2. Then, after the photoreceptor drum 2 has been preliminarily rotated by a predetermined period of time, the clutch 24 is cut off at the same time as stopping of the photoreceptor drum 2.

(ii) When a print switch is turned ON, the clutch 24 is connected at the timing in which a copy signal is outputted from the CPU 35, and simultaneously, the main motor M1 is driven for the photoreceptor drum 2 to start rotation. Thereafter, the clutch 24 is cut off at a timing in which the exposure with respect to the photoreceptor drum 2 is started.

(iii) After completion of transfer of the image with respect to the transfer material, the clutch 24 is connected at a timing in which a trailing edge of the image passes the position confronting the cleaning roller 11, and thereafter, the clutch 24 is cut off simultaneously with the stopping of the photoreceptor drum 2.

(iv) In the case where the image formation is continuously effected, after completion of the previous transfer, the clutch 24 is connected at a timing in which the trailing edge of the image passes the position confronting the cleaning roller 11, and is disconnected at a timing in which the next exposure is started.

Hereinafter, cleaning function of the cleaning device 11 in the disconnected and connected states will be explained with reference to FIGS. 1 and 2.

Firstly, in the state where the clutch 24 has been disconnected, since the gear 25 may be freely rotated, the cleaning roller 11 held in pressure contact with the surface 2*a* of the photoreceptor drum 2 is rotated in a direction indicated by an arrow A following rotation of the photoreceptor drum 2. Thus, as the photoreceptor drum 2 rotates, part of the residual toner passing through the contacting portion between the surface 2*a* of the photoreceptor drum 2 and the cleaning roller 11 adheres to the surface of the cleaning roller 11. The toner adhering to the surface of the cleaning roller 11 is transported to the side remote from the photoreceptor drum 2 following rotation of said cleaning roller 11, and scraped off by the scrapers 13 so as to be dropped into the toner collecting portion 28 through the opening 29. The toner accommodated in the toner collecting portion 28 is transported up to a waste toner storage (not shown) provided outside the cleaning device 1 as the collecting spiral 14 is driven for rotation.

The toner remaining on the surface 2*a* of the photoreceptor drum 2 without being removed by the cleaning roller 11, is scraped off by the cleaning blade 21. In the above case, since the cleaning roller 11 is rotated only following rotation of the photoreceptor drum 2 without obstructing rotation thereof, no irregular rotation takes place on said photoreceptor drum 2.

Hereinafter, cleaning function of the cleaning device 1 in the state where the clutch 24 has been connected, will be explained.

Upon connection of the clutch 24, the gear 25 stops rotation, and thus, the cleaning roller 11 also stops rotation, whereby a speed difference is produced between the rotating photoreceptor drum 2 and the cleaning roller 11, thus generating a friction force at the pressure contact portion therebetween. By this friction force, the toner passing through such pressure contact portion is positively dropped downwardly. As described above, when the clutch 24 is connected, the toner is removed also by the cleaning roller 11 besides the removal thereof by the cleaning blade 21, and therefore, the toner may be removed more effectively than in the case where the clutch 24 has been disconnected. Although the area to be fully cleaned by the cleaning roller 11 and the cleaning blade 21 through copying function in one time is not of the total area on the surface 2*a* of the photoreceptor drum 2, since areas to be cleaned by said cleaning roller 11 and said cleaning blade 21 are different according to copying operations, the whole area of the surface 2*a* may be sufficiently cleaned as the copying operation is effected by a predetermined number of times. Therefore, the toner remaining on the surface 2*a* of the photoreceptor drum 2 is not accumulated so much as will adversely affect the image quality.

On the other hand, since the friction force acting between the cleaning roller 11 and the photoreceptor drum 2 functions as a resistance against rotation of the photoreceptor drum 2, this tends to result in the irregular rotation of said photoreceptor drum 2. However, owing to the fact that the connection of the clutch 24 is effected in the period other than that from the starting of exposure to completion of transfer as described earlier, the image to be formed on the transfer material is not affected thereby.

Moreover, according to the above embodiment, since the clutch 24 is arranged to be connected after the trailing edge of the toner image has passed through the position confronting the cleaning roller 11, there is no possibility that the toner remaining on the surface of the photoreceptor drum 2 i.e. image holding member after transfer, is scraped off by the cleaning roller 11, and consequently that the toner falls onto portions other than the toner collecting portion 28.

2nd Embodiment

In the first embodiment, although the cleaning roller 11 is arranged to be stopped in the period other than that from the starting of the exposure to the completion of the transfer, the arrangement may, for example, be so modified that the cleaning roller 11 is forcibly driven so as to be rotated in a direction opposite to that of the photoreceptor drum 2 in the contacting region with respect to said photoreceptor drum 2 as in a second embodiment to be described hereinafter.

Figure 6:
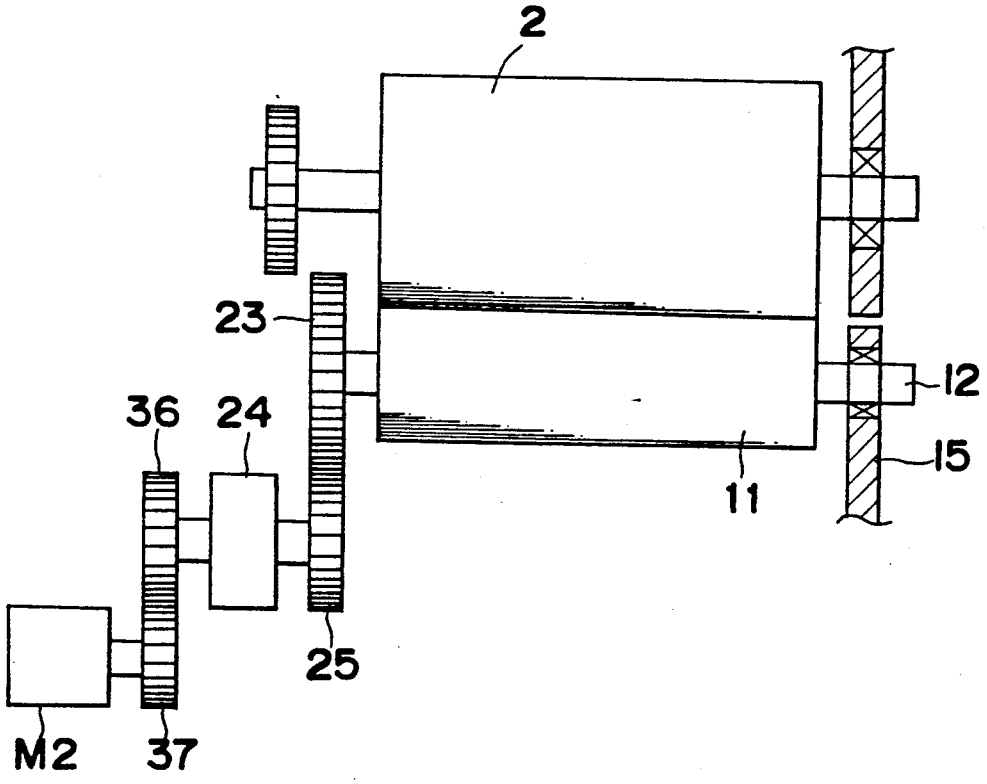
FIG. 6 is a fragmentary front elevational diagram, partly in section, showing essential portions of a cleaning device according to a second embodiment of the present invention.
Figure 7:
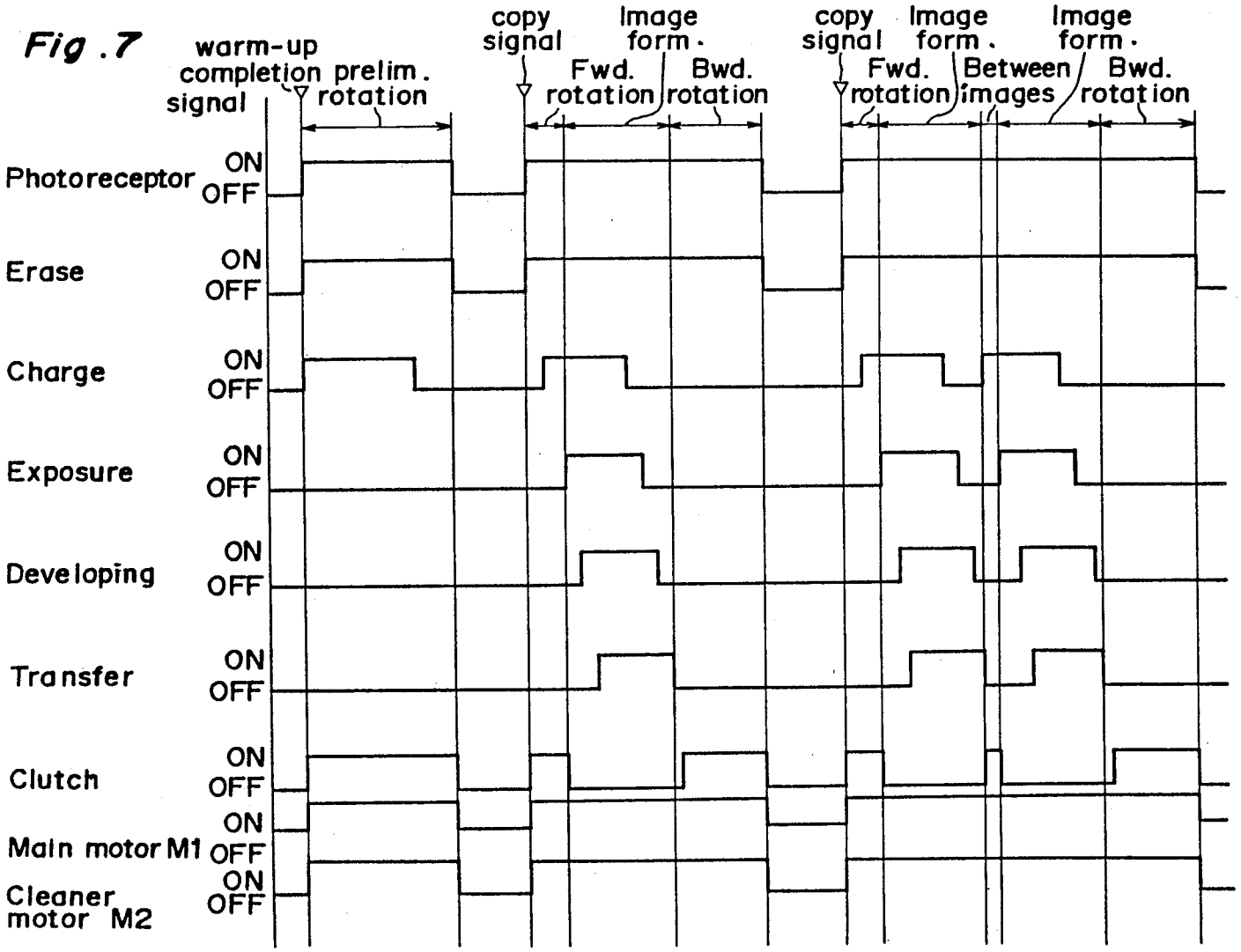
FIG. 7 is a time-chart similar to FIG. 5, which particularly relates to the second embodiment of the present invention.

FIGS. 6 and 7, relate to a case where another motor M2 is provided to drive the cleaning roller 11. In FIG. 6, at a side of the clutch 24 remote from the side thereof attached with the gear 25, there is mounted another gear 36, which is in mesh with a gear 37 mounted on a driving shaft of the motor M2. As shown in FIG. 7, this motor M2 is driven in synchronization with the main motor M1. Accordingly, upon connection of the clutch 24, the driving force of the motor M2 is transmitted to the cleaning roller 11, which is driven in a direction opposite to that of the photoreceptor drum 2, while on the contrary, upon disconnection of the clutch 24, the cleaning roller 11 rotates following rotation of the photoreceptor drum 2. It is to be noted here that, in the above second embodiment, the timings for connecting and disconnecting the clutch 24 are the same as those in the first embodiment described earlier.

As is seen from the above description, in the second embodiment of the present invention, since the cleaning roller 11 is arranged to be rotated in the direction opposite to that of the photoreceptor drum during the period from the exposure starting up to the transfer completion, the friction force between the cleaning roller 11 and the photoreceptor drum 2 is larger than that in the first embodiment in which the rotation only of the cleaning roller 11 is stopped. Accordingly, in the second embodiment, cleaning of the photoreceptor drum 2 may be effected more effectively as compared with that in the first embodiment. In the second embodiment, although the motor M2 exclusive for driving the cleaning roller 11 is provided, it may be so modified, for example, to drive the cleaning roller by the main motor M1.

It is to be noted here that in the foregoing embodiment, although the relative speed difference is imparted to the cleaning roller with respect to the photoreceptor drum, i.e. image holding member, at the timing in which the most downstream portion of the toner image on the image holding member passes through the position confronting the cleaning roller, the arrangement may, for example, be so modified, as to impart the speed difference to the cleaning roller with respect to the image holding member at a timing in which the transfer is completed. In this case, however, it is necessary to adopt an arrangement to collect the toner scraped off through forcible rubbing against the cleaning roller, e.g. to dispose the toner collecting portion under the cleaning roller.

It should be noted here that, in the foregoing embodiments, although the cleaning roller is described as provided at the upstream side of the cleaning blade with respect to the rotating direction of the image holding member, the present invention may also be applied, for example, to a cleaning device in which the cleaning roller is disposed at the downstream side of the cleaning blade or the cleaning blade is dispensed with or to a cleaning device which employs a fur brush or the like. In the case where the cleaning roller is disposed at the downstream side of the cleaning blade, the cleaning roller is capable of effectively removing only the residual toner, etc. which were not removed by the cleaning blade.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as included therein.

What is claimed is:

1. A cleaning device for removing substances remaining on a rotatable image holding member in an image forming apparatus, which comprises:

a cleaning roller rotatably supported in a state that a surface thereof contacts a surface of the image holding member at a contact region so as to remove the substances remaining on the surface of said image holding member, and a drive change-over means arranged to change-over driving to rotate said cleaning roller to follow the rotation of said image holding member so that the surfaces of said cleaning roller and said image holding member move together in the same direction at the contact region during a period in which image formation is effected by said image holding member, and to impart a speed difference to the surface of said cleaning roller with respect to the surface of said image holding member at the contact region during other periods in which the image formation is not effected.

2. A cleaning device as claimed in claim 1, wherein said drive change-over means includes a clutch means coupled to a rotary shaft of said cleaning roller so as to connect said clutch means during non-image forming period for stopping rotation of said cleaning roller.

3. A cleaning device as claimed in claim 1, wherein said drive change-over means includes a motor and a clutch means for selectively connecting or releasing driving of said motor with respect to said cleaning roller so as to drive said cleaning roller for rotation in a reverse direction at said contact region during the non-image forming period.

4. A cleaning device for removing substances remaining on a rotatable image holding member in a image forming apparatus, which comprises:

a cleaning roller rotatably supported in a state that a surface thereof contacts a surface of the image holding member at a contact region so as to remove the substances remaining on the surface of said image holding member, a cleaning blade having a forward edge portion contacting the surface of said image holding member and a base portion so as to scrape the remaining substances off the surface of the image holding member, a holder which holds the base portion of the cleaning blade and which causes the forward edge portion of said cleaning blade to contact the surface of the image holding member under pressure, and a drive change-over means arranged to change-over driving to rotate said cleaning roller to follow the rotation of said image holding member so that the surfaces of said cleaning roller and said image holding member move together in the same direction at the contact region during a period in which image formation is effected by said image holding member, and to impart a speed difference to the surface of said cleaning roller with respect to the surface of said image holding member at the contact region during other periods in which the image formation is not effected.

5. A cleaning device as claimed in claim 4, wherein said cleaning blade is provided at a downstream side of said cleaning roller with respect to the rotational direction of said image holding member.

6. An image forming apparatus which comprises:

an image holding member rotatably provided for rotation in one direction, a latent image forming means for forming an electrostatic latent image on a surface of said image holding member, a developing means which forms a toner image by developing the electrostatic latent image formed on said image holding member, a transfer means for transferring the toner image on the image holding member onto a transfer material, a cleaning roller rotatably supported in a state that a surface thereof contacts a surface of the image holding member at a contact region so as to remove substances remaining on the surface of said image holding member without being transferred, and a control means adapted to cause said cleaning roller to rotate to follow the rotation of said image holding member so that the surfaces of said cleaning roller and said image holding member move together in the same direction at the contact region during one period from starting of formation of the electrostatic latent image by the latent image forming means up to passing of a trailing edge of the electrostatic latent image through said transfer means, and to impart a speed difference to the surface of said cleaning roller with respect to the surface of said image holding member at the contact region during periods other than said one period.

7. An image forming apparatus as claimed in claim 6, wherein the speed difference is arranged to be imparted to said surface of said cleaning roller with respect to said surface of said image holding member after the trailing edge of said electrostatic latent image has passed through said cleaning roller.

* * * * *

UNITED STATES PATENT AND TRADEMARK OFFICE

CERTIFICATE OF CORRECTION

PATENT NO. : 5,220,391

DATED : June 15, 1993

INVENTOR(S) : Keigo Tange

It is certified that error appears in the above-identified patent and that said Letters Patent is hereby corrected as shown below:

On the cover page and at the top of col. 1, change the third word of the title of the patent from "APPORATING" to --APPARATUS--.

In col. 4, line 40, after "device" insert --1--.

In col. 4, line 55, change "tone" to --toner--.

Signed and Sealed this

Eighth Day of March, 1994

Bruce Lehman

*Attest:*

BRUCE LEHMAN

*Attesting Officer*

*Commissioner of Patents and Trademarks*